US010260743B2

(12) United States Patent
Giraud et al.

(10) Patent No.: US 10,260,743 B2
(45) Date of Patent: Apr. 16, 2019

(54) BURNER FOR A REHEATING FURNACE OR HEAT TREATMENT FURNACE FOR STEEL INDUSTRY

(71) Applicant: FIVES STEIN, Maisons Alfort (FR)

(72) Inventors: Patrick Giraud, Paris (FR); Sebastien Lemaire, Paris (FR)

(73) Assignee: FIVES STEIN, Maisons Alfort (FR)

( * ) Notice: Subject to any disclaimer, the term of this patent is extended or adjusted under 35 U.S.C. 154(b) by 63 days.

(21) Appl. No.: 15/038,901

(22) PCT Filed: Nov. 25, 2014

(86) PCT No.: PCT/EP2014/075540

§ 371 (c)(1),
(2) Date: May 24, 2016

(87) PCT Pub. No.: WO2015/078862

PCT Pub. Date: Jun. 4, 2015

(65) Prior Publication Data

US 2017/0114999 A1 Apr. 27, 2017

(30) Foreign Application Priority Data

Nov. 26, 2013 (FR) ..... 13 61634

(51) Int. Cl.
*F23D 14/84* (2006.01)
*F27B 9/10* (2006.01)
(Continued)

(52) U.S. Cl.
CPC ..... *F23D 14/84* (2013.01); *F23D 14/22* (2013.01); *F27B 9/10* (2013.01); *F27D 99/0033* (2013.01);
(Continued)

(58) Field of Classification Search
CPC ..... F23D 14/84; F23D 14/22; F23C 2900/05082; F23C 2900/06041; F27B 9/10
(Continued)

(56) References Cited

U.S. PATENT DOCUMENTS 5,217,363 A * 6/1993 Brais ..... F23D 14/22 239/401
6,176,894 B1 * 1/2001 Anderson ..... F23D 14/22 75/10.4
(Continued)

FOREIGN PATENT DOCUMENTS

EP 0 823 593 A2 2/1998
EP 0 974 552 A2 1/2000
(Continued)

OTHER PUBLICATIONS

International Search Report, dated Jan. 23, 2015, from corresponding PCT application.

*Primary Examiner* — Avinash Savani
*Assistant Examiner* — Rabeeul Zuberi
(74) *Attorney, Agent, or Firm* — Young & Thompson

(57) ABSTRACT

Burner for an oven for reheating siderurlogical products such as billets, blooms or slabs, or for heat treatment oven, which is equipped with a fuel injection device and with an oxidant feed body feeding feed orifices with oxidant, the burner having an axial direction; the injection device is designed to provide a central injection of fuel via an orifice in, or parallel to, the axial direction of the burner; the oxidant feed body includes two sets of four oxidant feed orifices, each set including two orifices situated above a horizontal plane passing through the axial direction of the burner, and two orifices situated below this plane, the orifices of a second set being further away from the horizontal plane than
(Continued)

those of the first set, the geometric axes of the orifices of the two sets making angles of inclination with respect to the axial direction of the burner.

8 Claims, 3 Drawing Sheets

(51) Int. Cl.
*F23D 14/22* (2006.01)
*F27D 99/00* (2010.01)

(52) U.S. Cl.
CPC *F23C 2202/40* (2013.01); *F23C 2900/05082* (2013.01); *F23C 2900/06041* (2013.01); *F23D 2900/21001* (2013.01)

(58) Field of Classification Search
USPC ..... 431/8, 181, 10, 165, 176 C, 186–189; 423/573.1
See application file for complete search history.

(56) References Cited

U.S. PATENT DOCUMENTS

| | | | | |
|---|---|---|---|---|
| 6,334,770 | B1 | 1/2002 | Giraud et al. | |
| 6,352,680 | B1 * | 3/2002 | Watson | C01B 17/04 423/237 |
| 2002/0055078 | A1 * | 5/2002 | Giraud | F23D 14/22 431/349 |
| 2008/0191160 | A1 * | 8/2008 | Meagher | F16K 11/076 251/366 |
| 2010/0326137 | A1 | 12/2010 | Rouchy et al. | |

FOREIGN PATENT DOCUMENTS

| | | |
|---|---|---|
| EP | 0 994 302 A | 4/2000 |
| FR | 2 784 449 A | 4/2000 |
| FR | 2 927 327 A1 | 8/2009 |

* cited by examiner

BURNER FOR A REHEATING FURNACE OR HEAT TREATMENT FURNACE FOR STEEL INDUSTRY

BACKGROUND OF THE INVENTION

Field of the Invention

The present invention relates to a combustion system generating a heat flux for heating materials, in particular for reheating furnaces for steel products.

Description of the Related Art

A combustion system of this type is known from EP 0994 302, corresponding to FR 2 784 449, also filed by the applicant company.

It is known that heat treatment furnaces, in particular reheating or holding furnaces, are designed to heat products, in particular slabs, blooms and similar, to the temperatures required for example for rolling or in order to obtain a given metallurgical structure.

It is also known that the quality of the treatment of a product, for example for rolling or heat treatment, requires a precise and uniform temperature inside the product, and that this temperature depends on the type of treatment required or the chemical composition of the product being treated.

For example, in reheating furnaces for metal products, the average temperature level is obtained by passing the products through heating zones that are characterized by a significant heat flux, which achieves a high degree of temperature heterogeneity in the products being reheated, in particular in furnaces fitted with axisymmetric flame burners according to the prior art.

In order to achieve the uniform temperatures required for subsequent treatment, the products leaving the heating zones pass through a soaking zone in which the heat input is very low, at zone temperatures close to the furnace discharge temperature, which makes it possible to equalize the temperatures throughout the thickness of the products. For economic reasons, the products cannot stay too long in this soaking zone and this soaking time is a compromise between the maximum acceptable heterogeneity value and the costs relating to construction of this zone of the furnace.

A first solution to improve the uniformity of the heat flux provided by the axisymmetric burners to the products in the furnace involves adjusting the wide-flame burner according to EP 0994302. Since international and local regulations limiting pollutant emissions, such as NOx, have significantly reduced acceptable maximum emission levels, burner technology needs to be improved.

The wide-flame burner according to EP 0994302 provides a significant improvement over axisymmetric flame burners by distributing the heat flux of the flame over a large surface parallel to the plane of the products.

The wide-flame burner makes it possible to limit the gradient of the temperature at the surface of the products that are positioned in the furnace provided with such burners parallel to the spreading plane of the flame.

This burner makes it possible to:

- reduce the duration of the soaking phase of the products, and therefore the length of the zone of reheating furnaces in which such soaking is performed,
- limit the risk of localized overheating of the product due to the absence of any very hot zones or hotspots in the flame. This feature helps to improve the final metallurgical status of the treated product,
- distribute the combustion throughout a volume that is larger than the volume covered by axisymmetric burners, which helps to better control the mix of reagents and products of combustion within the furnace enclosure. This reduces emissions of pollutants generated by combustion and reduces the formation of oxides on the surface of the reheated products.
- reduce the height of the furnace enclosure by reducing the dimension of the flame perpendicular to the plane of the products,
- replace a significant number of burners installed on the furnace roof by a smaller number of burners installed on the furnace walls. The fuel and oxidant distribution circuit is smaller, and cheaper to make.

Although these advantages have been recognized by users of wide-flame burners according to the prior art, the tunnel shape provided for in EP 0994302 limits the aspiration of ambient flue gases at the root of the fuel jets, which results in a local overheating zone of the products of combustion close to the tunnel, and this high temperature increases NOx emissions.

Emission levels of pollutants, in particular the level of NOx emitted, would be improved compared to EP 0994302 in order to keep this wide-flame burner technology as viable as possible by anticipating regulatory developments relating to pollutant emissions in different countries around the world.

SUMMARY OF THE INVENTION

One objective of the invention is to improve the design of wide-flame burners to help to achieve greater uniformity in the transmission of the heat flux generated by said flame, in order to reduce the temperature heterogeneity in the products to be reheated, and to help to improve heat transfer and to reduce the quantity of pollutants emitted, in particular NOx.

The invention addresses this problem by providing users with a new wide-flame burner technology for reheating steel products that maintains or improves the form of the wide flame while better distributing the heat flux to the product and significantly reducing pollutant emissions, in particular NOx.

According to the invention, a burner for a reheating furnace for steel products, such as billets, blooms or slabs, or for a heat treatment furnace that is fitted with a fuel injection device and an oxidant supply body supplying a circular oxidant baffle with oxidant supply ports, the burner supporting an axial direction, is characterized in that:

- the injection device is designed to ensure central injection of the fuel through a port in or substantially parallel to the axial direction of the burner,
- the oxidant baffle has two sets of four oxidant supply ports, each set having two ports located above a horizontal plane passing through the axial direction of the burner and two ports located beneath said plane, the ports in a second set being further away from said horizontal plane than the ports in the first set, the geometric axes of the supply ducts of the two sets of ports having angles of inclination in relation to said axial direction of the burner.

Preferably, the momentum ratio between the oxidant and the fuel is between 5 and 50, depending on the characteristics of the reagents, and in particular between 30 and 50 for natural gas or between 3 and 15 for lean gas.

Advantageously, the angles of inclination of the geometric axes of the oxidant supply ducts and the diameters of these supply ports are determined such as to:

a) produce a wide flame by the combination of the injection of fuel through the fuel port and the injection of oxidant through the oxidant ports of the first set, b) extend the volume of the reaction coming from the jets of the ports of the first set and the fuel port with the oxidant coming directly from the ports of the second set, or with the oxidant previously recirculated inside the furnace and diluted during said recirculation with the products of combustion of the furnace in a vertical plane, c) ensure this dilution by recirculating products of combustion such as to mix the reagents in a significant volume of flue gases before oxidizing the fuel with the residual oxidant to expand this reaction zone to a significant volume and limit the creation of hotspots, d) ensure combustion of the diluted fuel and oxidant, in particular with the products of combustion producing a limited amount of NOx.

Advantageously, a burner according to the invention is characterized by the combination of the relative positions of the fuel and oxidant injection ports, the diameter of the injection ports, the velocity of the fluids coming from these ports during operation and the angle of the supply ducts such that the jets of fuel, oxidant and recirculated combustion gases can be combined to control the convergence and mixing point of same.

Preferably, the axes of the oxidant supply ports are located within the horizontal planes, substantially parallel to the plane of the products, and are inclined in relation to the axial direction by an angle (a) for the ports of the second set and by an angle (b) for the ports of the first set.

The angle (a) of the geometric axes of the pairs of ports of the second set may be between 5° and 18°, and the axes are divergent. The angle (b) of the geometric axes of the pairs of ports of the first set may be between 10° and 20°, and the axes are divergent.

The expression "geometric axis of a port" shall be understood to mean the geometric axis of the opening out of the injection port.

Preferably, the pairs of oxidant supply ports open out into an output plane that is substantially equal to the plane corresponding to the internal face of the furnace.

Preferably, each of the two sets of ports comprises two groups of two ports, the axes of which are located in a plane parallel to the horizontal plane passing through the axial direction of the burner, the planes of the axes of the ports 8 or 8' of the second set being located at a distance $Y_8$ from said horizontal plane, and the planes of the axes of the ports 9 or 9' of the first set being located at a distance $Y_9$, and the ratio between the distances $Y_9$ to $Y_8$ is advantageously between 0.4 and 0.7.

The ports 8 and 8' of the second set are preferably at a distance from the axial vertical plane that is less than the distance to this plane from the ports 9 and 9' of the first set, and the ratio of the distances may be between 0.5 and 0.7.

The burner may be characterized by the presence of two oxidant boxes that can be supplied by independent circuits and that are designed to supply respectively the two sets of ports, and a third set of ports that are located radially inside the ports of the two first sets, which are designed to provide a long spread flame, while the third set of ports is designed to provide a short spread flame.

The burner may be characterized by the presence of two oxidant boxes supplied by independent circuits and that supply respectively the two sets of ports, and a third set of ports that are located radially inside the ports of the two first sets, which make it possible to obtain a long spread flame, while the third set of ports makes it possible to obtain a short spread flame.

The burner may include a pipe for injecting fuel formed by a plurality of tubes to use several different types of fuel.

BRIEF DESCRIPTION OF THE DRAWING FIGURES

Apart from the arrangements set out above, the invention comprises a certain number of other arrangements, which are dealt with in greater detail below in relation to example embodiments described with reference to the attached drawings, which are in no way limitative. In these drawings.

DETAILED DESCRIPTION OF THE INVENTION

In the wide-flame burner according to EP 0994302, the fuel is injected through ports oriented in a horizontal plane towards the outside of the burner, and the oxidant injection ports are also inclined toward the outside of the burner to generate the spread flame. This arrangement has been shown to encourage the rapid mixing of the oxidant and the fuel close to the front face of the burner, and therefore the formation of local hot zones in the flame, which encourages the formation of thermal NOx in these zones.

According to the invention, the injection means for the fuel and the oxidant have been improved to reduce the NOx produced, while retaining a spread flame, in order to ensure a slower fuel oxidization dynamic to reduce pollutant emissions.

Figure 1:
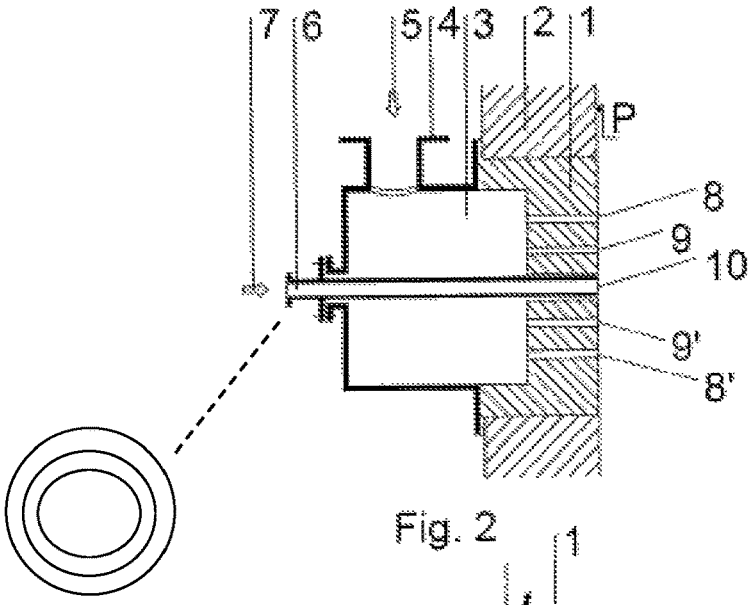
FIG. 1 is a schematic cross sectional view taken along the vertical plane I-I shown in FIG. 2, passing through the axial direction of a burner according to the invention. For the sake of simplicity, the ports have been shown using an unbroken line, even though they are outside the cross section.
Figure 2:
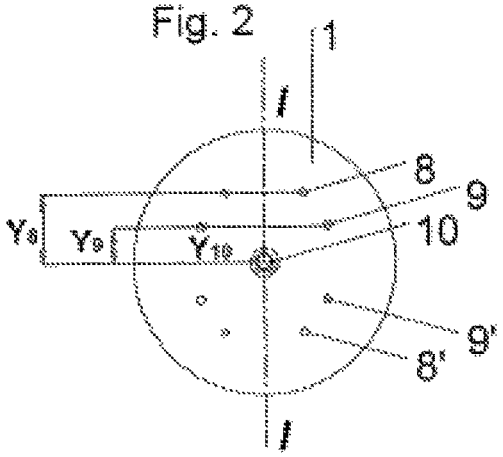
FIG. 2 is a front view of the burner from the inside of the furnace.
Figure 3:
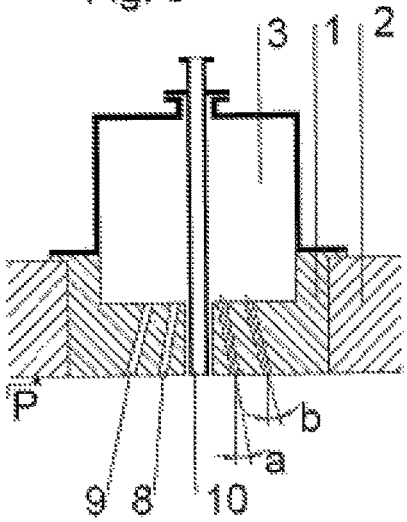
FIG. 3 is a schematic cross sectional view of the burner in a horizontal plane and seen from above. For the sake of simplicity, the injection ducts have been shown using an unbroken line, even though they are outside the cross section.

FIGS. 1 to 3 show that the burner comprises an oxidant baffle 1 installed in the side wall of the furnace 2, the front face of which is substantially aligned with the internal face of this furnace wall in the plane P, and an oxidant supply body 3 fitted with a connecting flange 4 to a combustion oxidant supply circuit shown schematically by the arrow 5. The fuel pipe 6 is connected to a supply circuit 7 shown symbolically by an arrow.

The fuel pipe 6, which is notably rectilinear, opens out substantially in the plane P of the wall of the furnace via a port 10 with an axis perpendicular to this plane. The axial direction of the burner may correspond to the geometric axis of the pipe 6 and of the port 10. The pipe 6 passes through the entire thickness of the baffle 1.

The pipe may be a single-fuel pipe (as shown in FIGS. 1-3) or a multi-fuel pipe incorporating multiple feeds, for example with a port for natural gas and another port for another fuel. The cross sectional view of FIG. 1 shows a fuel pipe formed by a plurality of tubes for using several different types of fuel. This arrangement of several injection means for several fuels may be realized in any of the ways provided for in the prior art. The fuel is injected in the axial direction of the burner using a central port or in a direction parallel to the axial direction of the burner using a port located substantially on the axis of the burner.

The oxidant supply body 3 supplies the oxidant baffle 1 with the oxidant injections using two sets of four ports, specifically two ports 8, 8 and 9, 9 symmetrical about a vertical plane and the ports 8', 8' and 9', 9' symmetrical to same about a horizontal plane. The four ports 9, 9' form a first set, and the four ports 8, 8' form a second set.

All of the injection ports in FIG. 3 are located substantially in the plane P of the wall of the furnace. The geometric axes of the oxidant injection ducts with ports 8, 8' of the second set are inclined by an angle (a) in relation to the perpendicular to the plane P, the geometric axes of the injection ducts of the first set with ports 9, 9' are inclined by an angle (b) in relation to the perpendicular to the plane P.

The axes of the pairs of ports 8, 8' of the second set are contained within a single plane parallel to the horizontal plane $Y_{10}$, passing through the axis of the port 10 at a distance $Y_8$, as shown in FIG. 2. The axes of the pairs of ports 9, 9' of the first set are contained in a single plane parallel to the horizontal plane at a distance $Y_9$.

Figure 4:
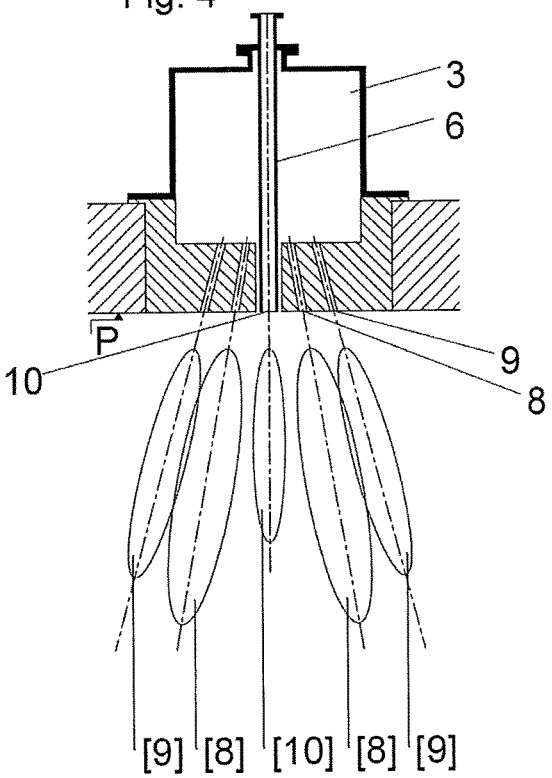
FIG. 4 is a cross sectional top view, similar to the view in FIG. 3, showing the fluid plumes coming out of the different ports. For the sake of simplicity, the ports have been shown using an unbroken line, even though they are outside the cross section.

Operation of the burner is shown schematically in FIG. 4, which shows the volumes associated with the reagent injections, these volumes having different dimensions depending on the injection points 8, 8', 9, 9' and 10. The result sought appears to be achieved by a specific combination of the positioning of the fuel and oxidant ports, the respective angles of the ports in relation to the plane P, and in the axial direction of the burner, and the momentum of each jet in relation to the neighboring jets. This makes it possible to control the reaction zones of the reagents shown schematically by plumes marked by numbers in square brackets [8], [9] and [10] in FIG. 4, in which the zone [10] corresponds to the fuel.

Figure 5:
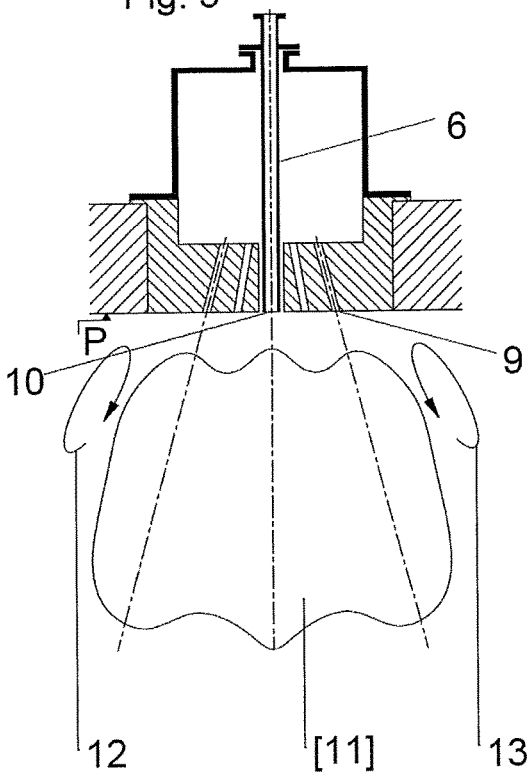
FIG. 5 is a cross sectional top view, similar to the view in FIG. 4, showing the volume of the flame started by the oxidant jets from the first set with the fuel jet, and the recirculating currents.

The oxidant ports 9 and 9' shown in FIGS. 2 and 3 are located in the immediate proximity of the fuel output port 10 and the axes of the ducts of same are inclined at an angle (b) of between 10° and 23° in relation to the perpendicular to the plane P. Said axes are within a horizontal plane and offset from the center of the burner such as to spread the flame out, i.e. there are not two independent and symmetrical flames, but a single flame spread out in the main directions determined by the ports 9 and 9', as shown by [11] in FIG. 5 and specific to this type of wide-flame burner.

This result is obtained by combining the relative positions of the fuel and oxidant injection ports, the diameter of the injection ports, the velocity of the fluids coming from these ports during operation and the angle of the supply ducts such that the fuel jets and the combustion gas/oxidant mixture jets can be combined to control the convergence and mixing point of same. The fuel jets and the recirculated combustion gas/oxidant mixture jets are cone-shaped and more open than the plumes shown for the sake of simplicity in FIG. 4, and the convergence point refers to the point of intersection of the fuel jet and the recirculated combustion gas/oxidant mixture jets. This makes it possible to control the progressive oxidation of the fuel and the dilution of the reagents with the products of combustion of the furnace.

A momentum ratio (mass flow multiplied by velocity) of the oxidant jets to the fuel jets is determined for the burner according to the invention. The momentum ratio between the oxidant and the fuel is between 5 and 50, depending on the characteristics of the reagents, and in particular between 30 and 50 for natural gas or between 3 and 15 for lean gas.

The oxidation of the fuel injected into the furnace via the port 10, in the plume [10] shown schematically, occurs gradually with the oxidant injected via the ports 9, 9' to spread the combustion throughout a significant flame volume, which lowers the average temperature of this flame. This phenomenon is accelerated by the recirculation of flue gases from the furnace, as shown by arrows 12 and 13 in FIG. 6, which gives the reagents time to mix before combining, which increases the volume of the flame and helps to slow down the phenomenon of oxidation of the fuel and to lower the average temperature of the flame. The dilution of the reagents, i.e. fuel and oxidant, in the furnace is effected with the products of combustion or flue gases present in this furnace at a temperature typically between 850° C. and 1450° C. The temperature of the oxidant injected in [8] and [9] is typically between 400° C. and 650° C.

Unlike the flames in burners in the prior art, in which combustion is essentially propagated on the surface with reaction zones at very high temperatures, according to the invention the oxidation reactions occur in the volume since the mixtures are at temperatures higher than the spontaneous combustion temperature, i.e. the temperature of the reaction enclosure and/or the temperature of the reagents when same are introduced into the furnace are high enough for these reactions to occur.

Since the oxidation reactions of the reagents according to the invention occur in a larger volume, the temperature of this volume is more uniform, with fewer high-temperature zones in the flame, which significantly reduces NOx production. This phenomenon is characterized by the formation of a flame with reduced luminosity compared to flames obtained in the prior art, this being obtained by recirculating combustion gases inside the furnace with the reagents injected via the ports 8, 8', 9 and 9'.

Figure 6:
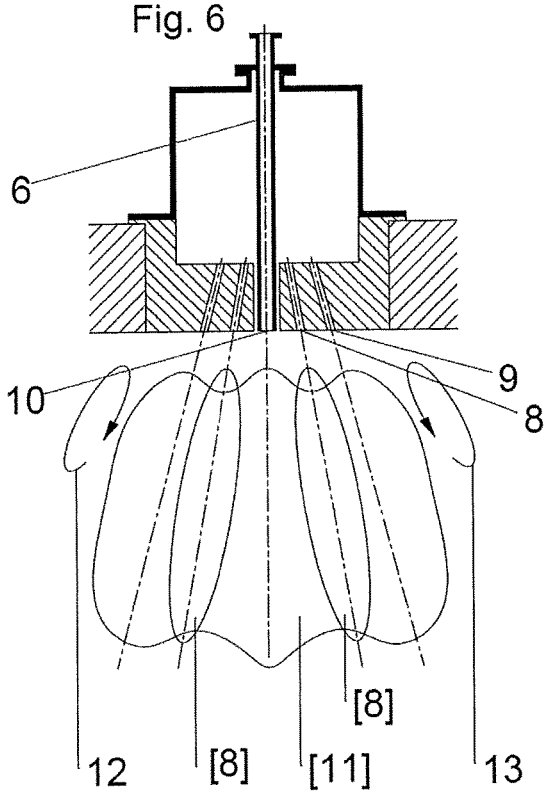
FIG. 6 is a top view, similar to the view in FIG. 4, showing the volume of the flame with the oxidant jets from the second set and the recirculating currents.

FIG. 6 shows the device for controlling the combustion carried out using the injection ports 8 and 8' of the second set arranged in planes parallel to the horizontal plane. The axes of the ports 8 and 8' are located at distances $Y_8$ greater than the distances $Y_9$ from the holes 9 and 9' to the horizontal plane of symmetry $Y_{10}$ of the burner.

The injection angles (a) of the geometric axes of the ports 8 in relation to the perpendicular to the plane P are advantageously set between 5° and 18° such as to produce the following effects on the flame created by injections from the ports 9, 9' and 10:

1) spreading of the flame in the horizontal plane to ensure compatibility with the height available in the furnace and to encourage the horizontal spreading of the combustion zone, 2) oxidation of the residual fuel that has not reacted with the oxidant jets 9, 9', 3) induction of recirculating currents comparable to those illustrated by the arrows 12 and 13 in FIG. 6 in order to further dilute the reagents with the flue gases from the furnace, which slows down the oxidation reaction of the fuel and causes this reaction to occur in a larger fuel volume, which thereby helps to reduce the hotspots in the flame, and therefore to limit the quantity of pollutants produced, primarily NOx.

In fact, a portion of the oxidant only reacts with the fuel after recirculation and dilution by the flue gases, which results in:

1) an increase in the reaction volume, 2) a lower average temperature of the reaction zone because same occurs in a larger reaction volume, 3) a reduction in thermal NOx emissions as a result of the reduction in the number and volume of hotspots in the flame.

It appears that the optimization of the flame produced by this fuel injector set 10 and the two sets of oxidant injectors 8, 8' and 9, 9' is preferably achieved through a combination of the following arrangements:

1) the position, diameter and angle of the oxidant injectors and ports of the first set 9, 9' located close to the plane of the fuel injector 10, 2) optimization of the number and relative positions of the oxidant injectors 9, 9' of the first set, the angle of inclination (b) of same and the diameters of same, and of the fuel injector 10, in combination with the ejection velocity of the reagents coming out of these injectors, 3) the position of the oxidant injectors 8, 8' of the second set, the angle of inclination (a) of same and the diameters of same in order to spread the reaction zone through the horizontal plane and generate a secondary recirculation of oxidant injected by the jets from these ports 8, 8' and the flue gases around the reaction zone, 4) the volume of the reaction zone achieved by the injectors 9, 9', the injectors 8, 8' and 10 makes it possible to achieve a significant reaction volume with a degree of uniformity that is well suited to heating steel products.

In a preferred embodiment of the invention, the ratio between the distances $Y_9$ and $Y_8$ is between 0.4 and 0.7.

The ports 8, 8' of the second set are preferably at a distance from the axial vertical plane, via the axis of the pipe 6, that is less than the distance to this plane from the ports 9, 9' of the first set, and the ratio of the distances may be between 0.5 and 0.7.

Figure 7:
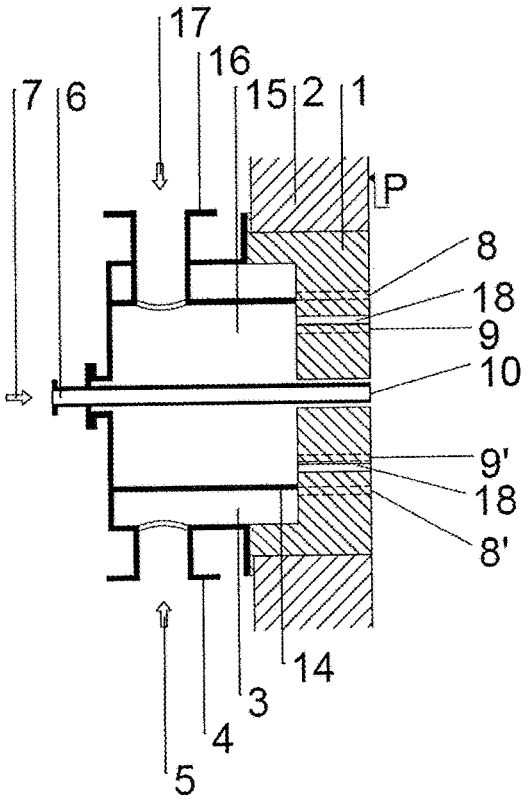
FIG. 7 is a cross sectional view taken along the vertical plane VII-VII in FIG. 8, similar to the view in FIG. 1, of a variant of the burner according to the invention.
Figure 8:
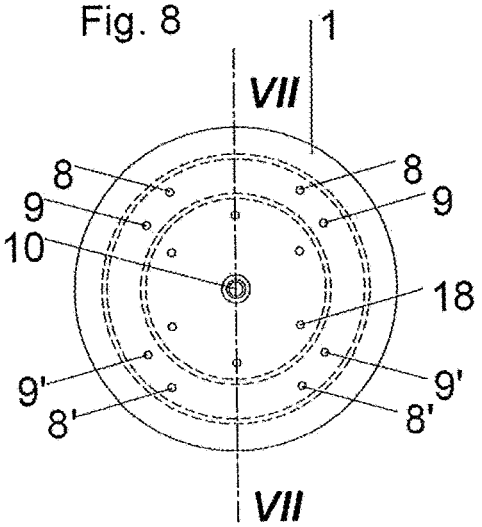
FIG. 8 is a front view of the burner in FIG. 7 from inside the furnace.

FIGS. 7 and 8 show a variant embodiment of the burner according to the invention in a flame-modulation application, i.e. enabling the burner to produce a long spread flame or a short spread flame depending on the operating mode of same.

FIG. 7 shows that the burner in the preceding figures is retained, with the oxidant supply body 3 of same supplying the pairs of ports 8, 8' and 9, 9' from the connecting flange 4 to the circuit 5. A partition 14, in particular a cylindrical partition, separates the oxidant supply body 3 from another chamber 15 forming an oxidant body supplied by the flange 16 from a circuit 17 summarily represented by an arrow. The oxidant supply body 3 supplies the two sets of pairs of ports 8, 8' and 9, 9', the position, angle of inclination, diameter and fluid velocity of which are set such as to produce a long spread flame similar to the one described above, and a third set of ports 18, distributed concentrically about the port 10, to produce a short spread flame. The ports 18, for example the six ports shown in FIG. 8, are advantageously distributed about a circumference centered on the geometric axis of the fuel port 10.

The two sets of oxidant ports 8, 8' and 9, 9' used to produce the long spread flame are substantially identical to those described above. They are positioned radially outside the third set of ports 18, as shown in FIG. 8.

This third set of ports 18, positioned radially inside the two first sets, makes it possible to obtain a short spread flame close to the wall of the furnace 2, which transmits energy to the extremity of the product located close to this wall, thereby enabling control of the distribution of thermal power to the product by selecting the long spread flame produced by the ports 8, 8' and 9, 9' supplied by the elements 5 and 4 and 3, or with a short spread flame obtained using the ports 18 supplied by the elements 17 and 15 and 16.

The burners working according to the invention therefore produce a diluted spread flame that enables the reagents to be diluted before oxidation of same with low levels of NOx production, either with a long spread flame or with a single burner with a long or short spread flame.

This burner is particularly suited to controlling the heat profile of the product in the furnace, for example according to the method described in EP 0994302.

Tests carried out on a test bench have demonstrated that the level of NOx produced by this type of burner, in particular with a long spread flame, is much lower than the limits set in current and future regulations. This very low NOx emissions level makes it possible to anticipate regulatory limits of pollutant emissions and therefore the related local taxes.

The invention claimed is:

1. A burner for a reheating furnace for steel products, billets, blooms or slabs, or for a heat treatment furnace that is fitted with a fuel injection device and an oxidant supply body supplying a circular oxidant baffle with oxidant supply ports, the burner having an axial direction and a combustion zone, comprising:

a port of the injection device designed to ensure central injection of the fuel substantially parallel to the axial direction of the burner, two sets of four oxidant supply ports of the oxidant supply baffle, each set having two ports located above a horizontal plane passing through the axial direction of the burner and two ports located beneath said plane, the ports in a second set being further away from said horizontal plane than the ports in the first set, the geometric axes of the supply ducts of the ports of the two sets having angles of inclination in relation to said axial direction of the burner, wherein the axes of the oxidant supply ports fall within horizontal planes parallel to the horizontal plane passing through the axial direction of the burner and are inclined in relation to a perpendicular to the horizontal plane passing through the axial direction of the burner by an angle (a) for the ports of the second set and by an angle (b) for the ports of the first set, the angle of inclination (a) of the geometric axes of the pairs of ports of the second set is between 5° and 18°, and the axes are divergent, the angle of inclination (b) of the geometric axes of the pairs of ports of the first set is between 10° and 20°, and the axes are divergent, the angles of inclination (a, b) of the geometric axes of the oxidant supply ports and the diameters of these supply ports are determined such as to:

a) produce a spread flame by the combination of the injection of fuel through the fuel port and the injection of oxidant through the oxidant ports of the first set to provide the spread flame in horizontal planes that encourage horizontal spreading of the combustion zone, b) extend the volume of the reaction coming from the jets of the ports of the first set and the fuel port with the oxidant coming directly from the ports of the second set, or with the oxidant previously recirculated inside the furnace and diluted during said recirculation with the products of combustion of the furnace in a vertical plane, c) ensure this dilution by recirculating products of combustion such as to mix the reagents in a significant volume of flue gases before oxidizing the fuel with the residual oxidant to expand this reaction zone to a significant volume and limit the creation of hotspots, d) ensure combustion of the diluted fuel and oxidant, in particular with the products of combustion producing a limited amount of NOx.

2. The burner according to claim 1, wherein the burner is adapted to have a momentum ratio between the oxidant and the fuel is between 5 and 50, depending on the characteristics of the reagents, and in particular between 30 and 50 for natural gas or between 3 and 15 for lean gas.

3. The burner according to claim 1, wherein a combination of relative positions of the fuel and oxidant injection ports, a diameter of the injection ports, a velocity of the fluids coming from these ports during operation and an angle of the supply ducts such that jets of fuel and of mixtures of oxidant and combustion gas can be combined to control a convergence and mixing point of the mixtures of oxidant and combustion gas.

4. The burner according to claim 1, wherein the pairs of oxidant supply ports open out into an output plane that is substantially equal to the plane corresponding to the internal face of the furnace.

5. The burner according to claim 1, wherein each set of ports comprises two groups of two ports each located in a plane parallel to the horizontal plane $Y_{10}$ passing through the axial direction of the burner, the planes of the ports of the first set being located at a distance $Y_9$ from said horizontal plane $Y_{10}$ and the planes of the ports of the second set being located at a distance $Y_8$, and in that the ratio between the distances $Y_9$ to $Y_8$ is between 0.4 and 0.7.

6. The burner according to claim 1, further comprising:

two oxidant boxes adapted to be supplied by independent circuits and adapted for supplying respectively the two sets of ports, and a third set of ports that are located radially inside the ports of the first two sets and so that the two sets of ports make possible to obtain a long-spread flame, while the third set of ports makes it possible to obtain a short-spread flame.

7. The burner according to claim 1, the fuel pipe is formed by a plurality of tubes for using several different types of fuel.

8. The burner according to claim 1, wherein the angle (b) of the geometric axes of the pairs of ports of the first set is between 10° and 20°, and the axes are divergent.

* * * * *